US006545399B1

(12) United States Patent
Chun

(10) Patent No.: US 6,545,399 B1
(45) Date of Patent: Apr. 8, 2003

(54) PANEL/SHUTTER MASK ASSEMBLY IN FLAT CATHODE RAY TUBE WITH CURVED RAIL FASTENER

(75) Inventor: Hyun Tae Chun, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 17 days.

(21) Appl. No.: 09/597,259

(22) Filed: Jun. 19, 2000

(51) Int. Cl.[7] ..... H01J 29/80
(52) U.S. Cl. ..... 313/402; 313/404; 313/407
(58) Field of Search ..... 313/402, 404, 313/405, 406, 407, 408

(56) References Cited

U.S. PATENT DOCUMENTS 4,551,651 A * 11/1985 van der Ven ..... 313/402
4,931,690 A * 6/1990 Kokubu et al. ..... 313/407
5,005,341 A * 4/1991 Park et al. ..... 313/479
5,416,377 A * 5/1995 Kim ..... 313/402
5,416,379 A * 5/1995 Inoue et al. ..... 313/402
5,502,349 A * 3/1996 Seo ..... 313/404
6,094,006 A * 7/2000 Park ..... 313/477
6,130,501 A * 10/2000 Tong et al. ..... 313/402
6,188,168 B1 * 2/2001 Han et al. ..... 313/405
6,215,237 B1 * 4/2001 Tsuchida et al. ..... 313/402
6,236,150 B1 * 5/2001 Park ..... 313/402
6,268,690 B1 * 7/2001 Yamazaki ..... 313/461
6,320,305 B1 * 11/2001 Ishikawa et al. ..... 313/402

FOREIGN PATENT DOCUMENTS

FR 2756662 A * 6/1998

* cited by examiner

*Primary Examiner*—Vip Patel
*Assistant Examiner*—Kevin Quarterman

(57) ABSTRACT

Panel/shadow mask assembly including a substantially flat panel having an effective surface with a coat of fluorescent material thereon, a rail fastener fitted to a periphery of the panel wherein a surface of the rail fastener on a side of the effective surface of the panel has a radius of curvature, and a shadow mask fixed to the rail fastener under pretension, thereby doubling a foreign matter washing efficiency and preventing a quality deterioration of the flat cathode ray tube.

12 Claims, 5 Drawing Sheets

PANEL/SHUTTER MASK ASSEMBLY IN FLAT CATHODE RAY TUBE WITH CURVED RAIL FASTENER

BACKGROUND OF THE INVENTION

1. Field of the Invention

The present invention relates to a flat cathode ray tube, and more particularly, to a panel/shadow mask assembly in a flat cathode ray tube assembled together by a rail fastener.

2. Background of the Related Art

In general, the cathode ray tube is used for displaying an image on a TV receiver, or monitor, of which flat cathode ray tube has an increasing demand because the flat cathode ray tube has improved performance, such as provision of a picture close to an actual image, and significant eye fatigue reduction. A system of a related art flat cathode ray tube will be explained, with reference to FIG. 1.

The panel/shadow mask assembly in the flat cathode ray tube is provided with the panel 1, a rail fastener 7 disposed along a periphery of the panel, and a shadow mask fastened to the rail fastener 7. In detail, there is a fluorescent film 1*a* of R, G, B three colors coated on an inside surface of the panel 1 in a fixed pattern, and a flat explosion proof glass 2 bonded with resin on an entire surface of the panel 1 for explosion prevention. And, there is a rectangular frame of a metal rail fastener 7, means for fastening the shadow mask 8, bonded with frit glass to an inside periphery of the panel, to a surface thereof facing a funnel 3 a shadow mask 8 of a metal having a plurality of holes 8*a* for passing electron beams 5 is welded under a pretension. There may be an inner shield 9 for shielding a geomagnetism and damping wires (not shown) for suppression of vibration of the shadow mask 8 fastened to the rail fastener 7. And, there is the funnel 3 having a neck portion 4 of a bottle neck form bonded with frit glass to a rear surface of the panel 1, with a cavity formed thereby at a high vacuum approx. $10^{-7}$ Torr, and the neck portion 4 has an electron gun 6 built therein for emitting the R, G, B three color electron beams 5 toward the inside surface of the panel.

In the foregoing flat cathode ray tube, if an image signal is provided to the electron gun 6 sealed in the neck portion 4 of the funnel 3, the electron beams 5 are emitted from cathodes. Then, the emitted electron beams 6 are controlled, accelerated, converged by voltage differences between voltages provided to respective electrodes in the electron gun 6, involved in locus change in a horizontal and vertical directions by an electro-magnetic field from a deflection yoke 10, pass through the holes 8*a* in the shadow mask 8, and cause the fluorescent film 1*a* coated on the inside surface of the panel 1 to emit light. As the foregoing series of steps are taken in succession, the flat cathode ray tube can reproduce the image.

In the meantime, the rail fastener 7 has long side rails 7*a* and short side rails 7*b* put together by end caps 7*c* into the rectangular frame for use in assembling the panel/shadow mask. Particularly, as shown in FIG. 2, the rail fastener 7 used the most widely has a section provided with an injection groove 7*d* on a side of the rail fastener 7 facing the panel 1 for injection of frit glass 11 and a welding surface 7*e* on an opposite side thereof for welding with a periphery of the shadow mask 8. Other than this, as shown in FIGS. 3A~3D, there are rail fasteners 7 with different types of sections are used for the panel/shadow mask assembly.

The following steps are taken for fabricating the assembly of the panel 1 and the shadow mask 8 by using such a rail fastener 7.

Frit glass powder is mixed with liquid into a gel, and injected into the injection groove 7*d* in the rail fastener 7 which is clean beforehand for a few times with the frit glass divided equally, and left until the frig glass is hardened. Next, under a state, top frit glass is injected on the already hardened frit glass 11 additionally, the panel 1 and the rail fastener 7 are aligned and welded, to bond the panel 1 and the rail fastener 7 together and to seal between the panel 1 and the rail fastener 7 by the bonding force of the top frit glass. Then, the welding surface 7*e* of the rail fastener 7 is ground flat for welding the shadow mask 8 to the panel 1 with a uniform gap therebetween. After a fluorescent material is coated in a region of the panel surface on an inner side of the rail fastener 7, exposed, and developed to form the fluorescent film 1*a* of a fixed pattern, the shadow mask 8 is given pretension in four directions before the shadow mask 8 is welded to the welding surface 7*e* of the rail fastener 7. In this instance, during the coating, exposure, and development, the panel 1 is washed for removal of impurities in a state the rail fastener 7 is attached thereto.

However, as shown in FIG. 4, in the related art rail fastener 7, since the flat inside surface of the related art rail fastener 7 is substantially vertical to a flow direction of the washing water (an arrow direction in FIG. 4), the washing water sprayed to an inner side of the rail fastener 7 can not be discharged to outside of the rail fastener 7 smoothly, but flows reversely into the inner side of the rail fastener 7 as the washing water hits onto the inside surface of the rail fastener 7. Consequently, foreign matters at corners of the rail fastener 7 are not washed away perfectly, but remained in gaps between the rail fastener 7 and the panel 1, that vaporizes, resulting to drop the vacuum. And, provided the foreign particles fly into the electron gun 6, the electron gun will cause discharge, and provided the foreign particles fly into the shadow mask 8, the foreign particles will block the holes 8*a* through which the electron beams 5 to pass through, that causes defects in products. Particularly, as larger sized cathode ray tubes are fabricated, a thickness '$\tau$' of the rail fastener 7 also becomes thicker proportionally, to deteriorate an efficiency of foreign matter removal by using the washing water further. Besides, the fixation of the rail fastener 7 to the panel 1 by using frit glass requires many steps, that is not favorable for productivity and price competition.

An accurate design for bonding the panel 1 and the rail fastener 7 is required as flit glass shrinks in hardening, and pores in the frit glass may drop an internal vacuum of the cathode ray tube, as the pores may discharge the air therein.

SUMMARY OF THE INVENTION

Accordingly, the present invention is directed to a panel/shadow mask assembly in a flat cathode ray tube that substantially obviates one or more of the problems due to limitations and disadvantages of the related art.

An object of the present invention is to provide a panel/shadow mask assembly in a flat cathode ray tube, which can improve a washing efficiency of foreign matter formed in a process of fabricating a cathode ray tube.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the panel/shadow mask assembly includes a substantially flat panel having an effective surface with a coat of fluorescent material thereon, a rail fastener fitted to a periphery of the panel wherein a surface of the rail fastener on a side of the effective surface of the panel has a radius of curvature, and a shadow mask fixed to the rail fastener under pretension.

The radius of curvature of the surface of the rail fastener on the side of the effective surface of the panel is preferably within a range of 4 mm~40 mm.

The panel and the rail fastener are bonded by using frit glass, and preferably by electrostatic bonding.

Thus, the present invention can prevent a quality deterioration of a flat cathode ray tube caused by foreign matter, and save production time and cost.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
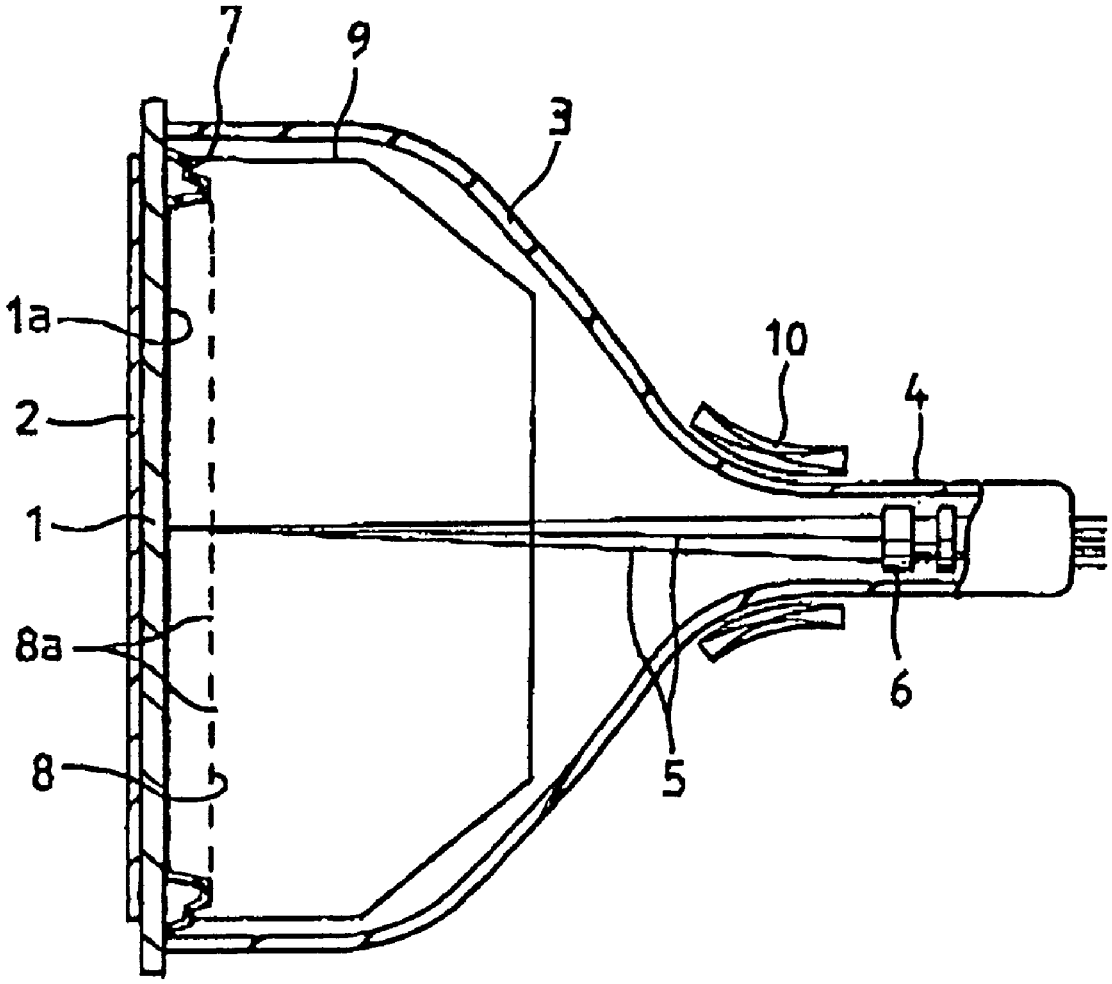
FIG. 1 Related Art
FIG. 1 illustrates a longitudinal section of a related art flat cathode ray tube.
Figure 2:
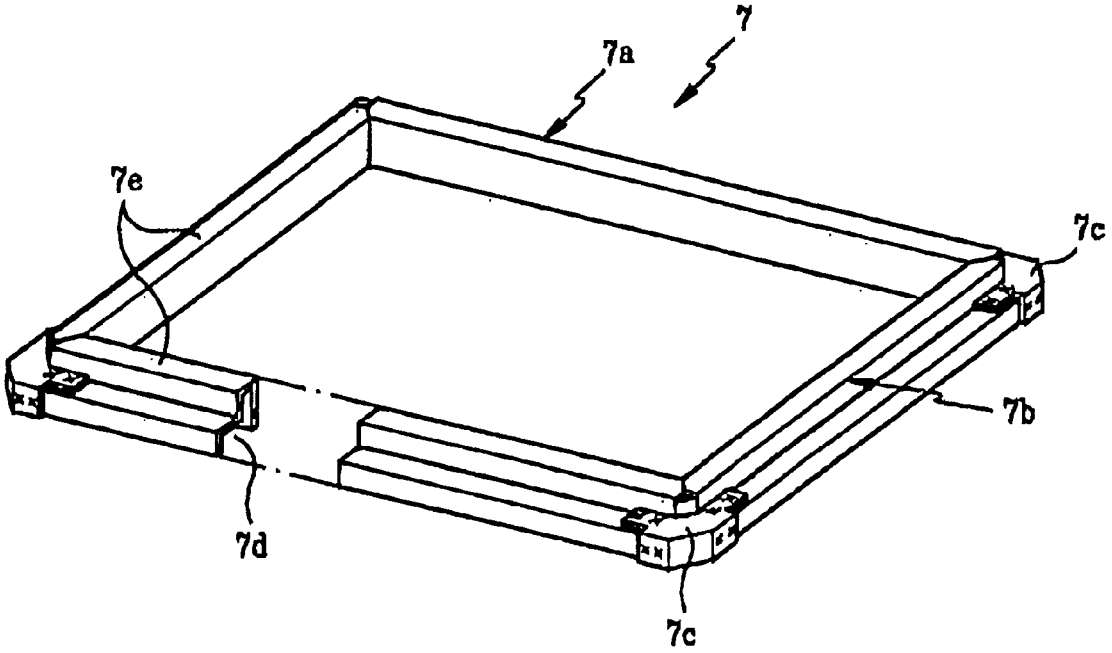
FIG. 2 Related Art
FIG. 2 illustrates a perspective view of a related art rail fastener.
Figure 3A:
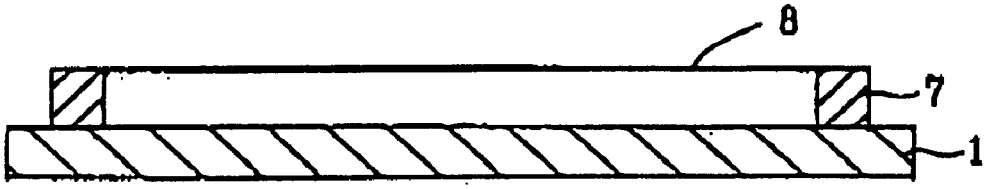
FIG. 3A Related Art
FIGS. 3A~3D illustrate different examples of the related art panel/shadow mask assembly.
Figure 3B:
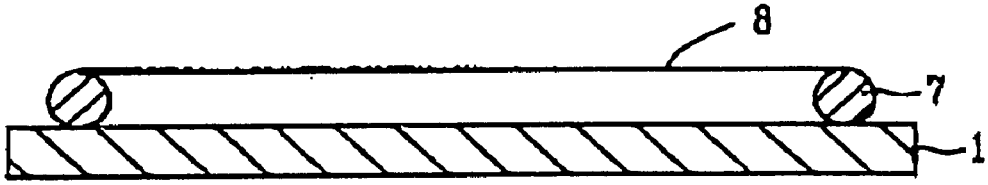
FIG. 3B Related Art
Figure 3C:
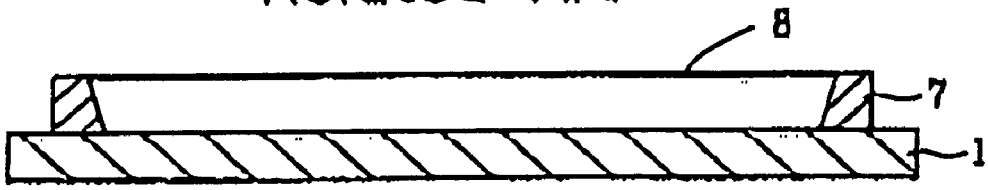
FIG. 3C Related Art
Figure 3D:
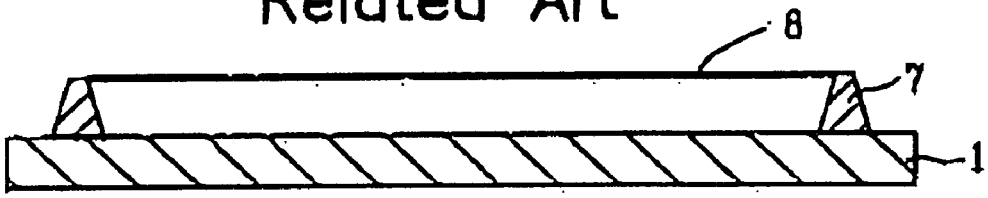
FIG. 3D Related Art
Figure 4:
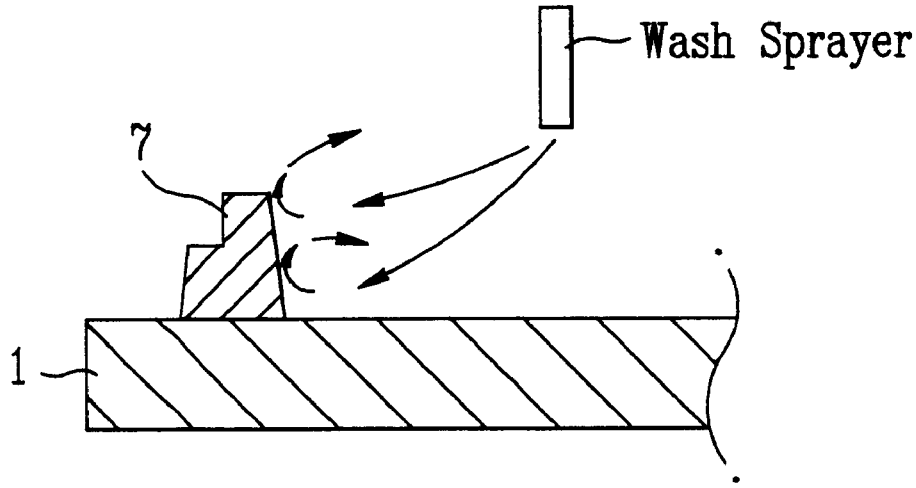
FIG. 4 Related Art
FIG. 4 illustrates a step of washing in the related art steps of assembling the panel/shadow mask, schematically.
Figure 5:
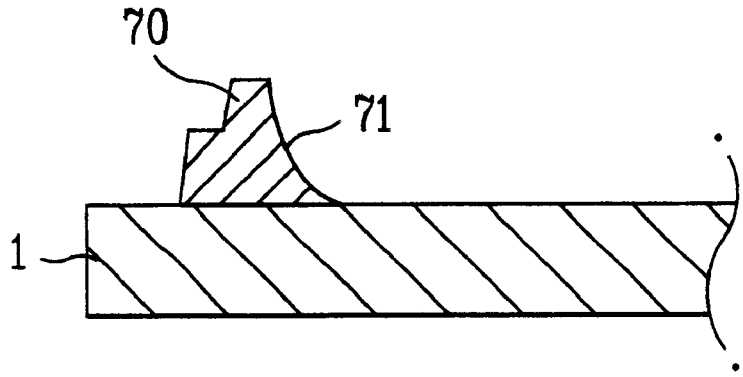
FIG. 5 illustrates a section showing a rail fastener in a mask/rail fastener assembly in accordance with a preferred embodiment of the present invention.

Reference will now be made in detail to the preferred embodiments of the present invention, examples of which are illustrated in the accompanying drawings. FIG. 5 illustrates a section showing a rail fastener in a mask/rail fastener assembly in accordance with a preferred embodiment of the present invention, FIGS. 6A~6B illustrate sections each showing a mask/rail fastener assembly in accordance with another preferred embodiment of the present invention, and FIG. 7 illustrates a section showing a step of washing in the steps of assembling the panel/shadow mask in accordance with a preferred embodiment of the present invention.

Referring to FIG. 5, the present invention suggests to provide a rail fastener 70, which is means for fixing the shadow mask 8 with an appropriate gap to the panel 1 in a panel/shadow mask assembly in a flat cathode ray tube, with a curved surface, for smooth discharge of washing water sprayed to an inner region of the rail fastener 70 along the curved surface to outside of the inner region in the steps of coating, exposure and development of black matrix and the fluorescent material. In this instance, a radius of a curvature of the curved surface 71 is preferably designed to be within a range of 4~40 mm, because an effect of smooth discharge of the washing water can not be obtained if the radius of curvature of the curved surface 71 is greater than 40 mm when the curved surface 71 comes close to a straight surface, and because a welding region between the rail fastener 70 and the shadow mask 8 is reduced excessively if the radius of curvature of the curved surface 71 is less than 4 mm.

Figure 6A:
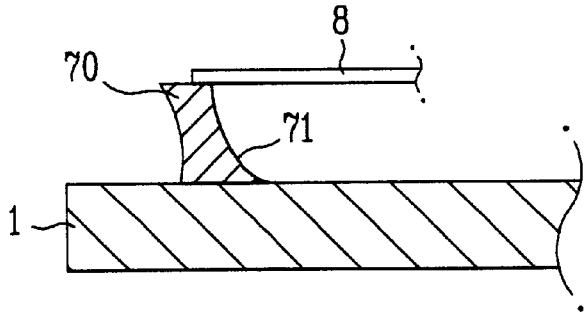
FIGS. 6A~6B illustrate sections each showing a mask/rail fastener assembly in accordance with another preferred embodiment of the present invention; and, FIG. 7 illustrates a section showing a step of washing in the steps of assembling the panel/shadow mask in accordance with a preferred embodiment of the present invention.
Figure 6B:
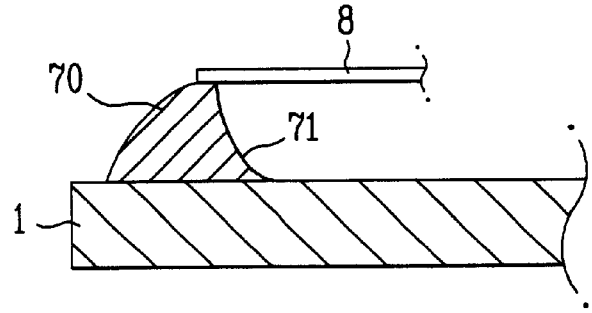
Figure 7:
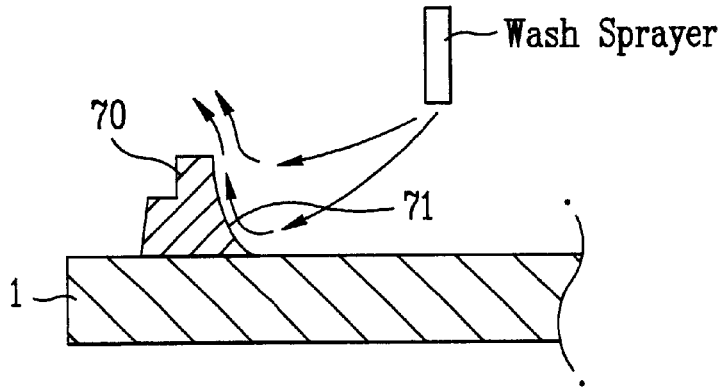

Other than the form shown in FIG. 5, as shown in FIGS. 6A~6B, as far as the rail fastener 70 has the curved surface 71 within the foregoing range of radius of curvature, the rail fastener 70 may have a different form. Particularly, the rail fastener 70 as shown in FIG. 6A is featured in that a surface for welding the shadow mask 8 thereto is enlarged, so that welding of a new mask can be carried out for a few time more while spots to which the shadow masks are welded initially are avoided. In this instance, the welding surface 72 of the rail fastener 70 is divided into a desired number, to weld an initial shadow mask 8 on one of the divided surface, and to weld a new shadow mask 8 on one other divided surface after the initially welded shadow mask is removed in reuse of the cathode ray tube due to defect found in a quality control, thereby providing an efficient structure which permit to enhance a ratio of reuse of the rail fastener 70 including the panel 1.

The effect of the panel/shadow mask assembly in a flat cathode ray tube of the present invention will be explained.

The radius of curvature within a range of 4~40 mm of an inside surface of the rail fastener 70 (a surface facing an effective surface of the panel) provided in the present invention permits a smooth discharge of the washing water sprayed onto the inner region of the rail fastener 70 to outside of the rail fastener in a washing step for washing out foreign matters. That is, because the washing water sprayed onto the inner region of the rail fastener 70 is naturally guided by the curved surface 71 of the rail fastener 70 and discharged to outside of the rail fastener 70 smoothly, to wash away particles of the fluorescent material remained in corners of the rail fastener and oxides and the like formed during the welding, the cleaning can be done better, to eliminate causes of defects, such as drop of vacuum of the cathode ray tube occurrence of discharge of the electron gun 6, blocking of the holes 8*a* of the shadow mask 8, and the like, in advance.

In the meantime, though the bonding between the rail fastener 70 and the panel 1 may be done by the frit glass as before, as described in the related art, an electrostatic bonding may be more ideal due to the many problems occurred in the frit glass bonding. In the electrostatic bonding of the panel 1 and the rail fastener 70, heat and voltage are used, basically. That is, under an elevated temperature, bonding surfaces of the panel 1 of glass and the rail fastener 70 of metal are brought into close contact, and a negative voltage "−" is applied to the panel 1 and a positive voltage "+" is applied to the rail fastener 70, then alkali elements, such as sodium oxide, in a composition of the glass is ionized at the elevated temperature. The sodium ions ionized thus move to a cathode by an electric field applied to opposite electrodes, and are reduced into sodium, and, the sodium is depleted from an interface of the panel 1 and the rail fastener 70, to cause a strong electrostatic force between an ion depletion layer in the panel 1 and a positive charge layer on a surface of the rail fastener 70 to bond the panel 1 and the rail fastener 70 strongly at the interface, and the stable metal oxide formed by chemical reaction of the moved ions maintains the strong bonding force. For reference, results of measurements of a thickness of a metal oxide, and an extent of soiled fluorescent material between the panel and the rail fastener after the panel 1 and the rail fastener 70 are electrostatically bonded under particular conditions are as follows.

A rail fastener 70 of an alloy of iron(60~75 wt %)+chrome (25~40 wt %) is formed and washed. Then, the panel 1 and the rail fastener 70 are aligned, and heated from 100° C. up to 704° C., a softening point of the panel 1, at a pressure of 1~50 kgf/cm2. A DC voltage of approx. 200~4000V are applied thereto while varying the voltage, to bond the panel 1 and the rail fastener 70, and cooled down under a temperature gradient low enough not to break the panel 1 and the rail fastener 70. The panel 1 and the rail fastener 70 electrostatically bonded following the foregoing steps are cut, and has a bonding strength and a thickness of the metal oxide at the interface measured by a tensile strength test and an interface analysis, and a coating process, a successive process, is carried out, and the extent of soiled fluorescent material is examined. As a result, it is known that the bonding strength of the two components is 10~300 kgf/cm2, the thickness of an oxide layer which bonds the rail fastener 70 and the panel 1 is 100~900 Å, and there is no foreign matter soiled in the interface of the two components. And, there is an amount of gas generation significantly less than the case when bonded by frit glass, on the whole allowing to provide a high quality cathode ray tube.

As has been explained, the curved inside surface of the rail fastener in the present invention can double a foreign matter washing efficiency since the washing water is discharged smoothly to outside of the rail fastener along the curved surface of the rail fastener even if the washing water is sprayed into an inner region of the rail fastener, that prevents a quality deterioration of the flat cathode ray tube. Moreover, the electrostatic bonding of the rail fastener with the panel in the panel/shadow mask assembly of he present invention can improve a quality of the flat cathode ray tube further by an additional foreign matter excluding effect and save a production time period and cost as the bonding process is simplified.

It will be apparent to those skilled in the art that various modifications and variations can be made in the panel/shadow mask assembly in a flat cathode ray tube of the present invention without departing from the spirit or scope of the invention. Thus, it is intended that the present invention cover the modifications and variations off this invention provided they come within the scope of the appended claims and their equivalents.

What is claimed is:

1. A panel/shadow mask assembly, comprising:

a substantially flat panel having an effective surface with a coat of fluorescent material thereon;

a rail fastener fitted to a periphery of the panel, wherein a surface of the rail fastener on a side of the effective surface of the panel is curved so as to be concave; and a shadow mask fixed to the rail fastener under pretension.

2. The panel/shadow mask assembly as claimed in claim 1, wherein a radius of curvature of the surface of the rail fastener on the side of the effective surface of the panel is within a range of 4 mm~40 mm.

3. The panel/shadow mask assembly as claimed in claim 1, wherein the panel and the rail fastener are bonded using frit glass.

4. The panel/shadow mask assembly as claimed in claim 1, wherein the panel and the rail fastener are bonded electrostatic bonding.

5. A CRT comprising the panel/shadow mask assembly of claim 1.

6. A rail fastener for a panel/shadow mask assembly having a substantially flat panel having an effective surface with a coat of fluorescent material disposed thereon, a rail fastener fitted to a periphery of the panel and a shadow mask fixed to the rail fastener under pretension, the improved rail fastener comprising:

a curved surface on a side of the effective surface of the panel, the surface being curved so as to be concave.

7. The improved rail fastener as claimed in claim 6, wherein a radius of curvature of the surface of the rail fastener on the side of the effective surface of the panel is within a range of 4 mm~40 mm.

8. A panel/shadow mask assembly, comprising:

a substantially flat panel having a coat of fluorescent material disposed thereon;

a rail fastener fitted to a periphery of the panel, wherein an inwardly facing surface of the rail fastener is curved so as to be concave; and a shadow mask fixed to the rail fastener.

9. The panel/shadow mask assembly as claimed in claim 1, wherein a radius of curvature of the surface of the rail fastener on the side of the effective surface of the panel is within a range of 4 mm~40 mm.

10. The panel/shadow mask assembly as claimed in claim 8, wherein the panel and the rail fastener are bonded using frit glass.

11. The panel/shadow mask assembly as claimed in claim 8, wherein the panel and the rail fastener are bonded by electrostatic bonding.

12. A CRT comprising the panel/shadow mask assembly of claim 8.

* * * * *